US006691679B2

(12) United States Patent
Pursifull et al.

(10) Patent No.: US 6,691,679 B2
(45) Date of Patent: Feb. 17, 2004

(54) SYSTEM AND METHOD FOR CONTROLLING AN OPERATIONAL POSITION OF A THROTTLE VALVE IN AN ENGINE

(75) Inventors: Ross Dykstra Pursifull, Dearborn, MI (US); Tobias John Pallett, Point Cook (AU)

(73) Assignee: Ford Global Technologies, LLC, Dearborn, MI (US)

( * ) Notice: Subject to any disclaimer, the term of this patent is extended or adjusted under 35 U.S.C. 154(b) by 12 days.

(21) Appl. No.: 09/997,763

(22) Filed: Nov. 29, 2001

(65) Prior Publication Data

US 2003/0098013 A1 May 29, 2003

(51) Int. Cl.[7] ..... F02D 1/00
(52) U.S. Cl. ..... 123/399; 123/361
(58) Field of Search ..... 123/399, 361, 123/395, 396, 319, 323, 327, 339.1

(56) References Cited

U.S. PATENT DOCUMENTS 4,549,517 A * 10/1985 Kamiyama ..... 123/478
4,901,695 A 2/1990 Kabasin et al.
5,016,588 A * 5/1991 Pagdin et al. ..... 123/399
5,069,181 A * 12/1991 Togai et al. ..... 123/350
5,107,425 A 4/1992 Donges et al.
5,136,880 A 8/1992 Norgauer
5,260,877 A 11/1993 Drobny et al.
5,452,697 A 9/1995 Sasaki et al.
5,852,996 A 12/1998 Nakamura et al.
6,311,679 B1 * 11/2001 Druzhinina et al. ... 123/568.21
6,363,316 B1 * 3/2002 Soliman et al. ..... 701/104
6,367,449 B1 * 4/2002 Moteki et al. ..... 123/399
6,560,528 B1 * 5/2003 Gitlin et al. ..... 701/115

* cited by examiner

*Primary Examiner*—John Kwon

(57) ABSTRACT

A control system (10) and method for controlling an operational position of a throttle valve in an engine. The system includes a position sensor (16) operably connected to the throttle valve that generates a first signal. A controller is operably connected to the position sensor. The controller (18) is configured to determine a current position of the throttle valve using a transfer function defining a curve with no breakpoints and the signal from the position sensor. The controller (18) is further configured to change the operational position of the throttle valve based on the current position and a desired position of the throttle valve.

10 Claims, 4 Drawing Sheets

SYSTEM AND METHOD FOR CONTROLLING AN OPERATIONAL POSITION OF A THROTTLE VALVE IN AN ENGINE

TECHNICAL FIELD

The present invention relates generally to a control system for an engine of an automotive vehicle, and more particularly to a method and apparatus for controlling an operational position of a throttle valve in the engine.

BACKGROUND OF THE INVENTION

Electronic engine controllers have used position sensors for closed loop control of throttle valves. A desired resolution for the position sensor depends on the specific application of the sensor. Also for a particular application the desired resolution may vary throughout a desired position sensing range. For example, the preferred resolution for the throttle position sensor may be higher at lower position angles (near a closed position) versus higher position angles. Typically, a position sensor has an output signal defined by a transfer function with different slopes is preferred for sensor fault detection.

Traditionally, throttle positions sensors have output signals defined by linear transfer functions. An engine controller uses the linear transfer function characteristic to determine an operational position of a throttle valve based on the output signal. Unfortunately, the position sensors, having a single sloped linear transfer function, have a relatively equivalent resolution over the entire range of operation which may be undesirable for throttle valve applications.

Further, some electronic controllers utilize multiple slope linear transfer functions to map a throttle position sensor voltage to a throttle position. The multiple slope linear transfer functions allow for a varying position resolution over the position sensing range that may be desired for throttle valve applications. However, each of these multiple slope linear transfer functions have a breakpoint which is a point where two line segments with different slopes meet. As a result, position measurement of throttle valve near these breakpoints may result in position measurement errors.

The inventors herein have recognized that it would be desirable to have a position control system with increased resolution in important operational regions of interest that is simpler to implement and more accurate than known methods.

SUMMARY OF THE INVENTION

The foregoing and advantages thereof are provided by a method and apparatus for controlling an operational position of a throttle valve in an engine. The system includes a position sensor operably connected to the throttle valve that generates a first signal. A controller is operably connected to the position sensor. The controller is configured to determine a current position of the throttle valve using a transfer function defining a curve with no breakpoints and the signal from the position sensor. The controller is further configured to change the operational position of the throttle valve based on the current position and a desired position of the throttle valve.

One of several advantages of the present invention is that it provides an improved method of determining a position of a device, with increased accuracy, due to increased resolution in a range where more resolution is desired.

Additionally, the present invention provides increased resolution in a control system that has manufacturing and interpreting ease equal to or better than traditional control systems.

Furthermore, the present invention provides several alternatives that have different varying slope conversion characteristics as to satisfy various different applications.

The present invention itself, together with attendant advantages, will be best understood by reference to the following detailed description, taken in conjunction with the accompanying figures.

BRIEF DESCRIPTION OF THE DRAWING

For a more complete understanding of this invention reference should now be had to the embodiments illustrated in greater detail in the accompanying figures and described below by way of examples of the invention wherein.

DETAILED DESCRIPTION OF THE PREFERRED EMBODIMENT

In the following description, various operating parameters and components are described for one constructed embodiment. These specific parameters and components are included as examples and are not meant to be limiting.

Also in the following description, the term "position" does not refer to a location in a vehicle. Position refers to an operational for a throttle valve. For example, an operational position of a throttle valve may vary from zero degrees (closed position) to ninety degrees (full open position).

Figure 1:
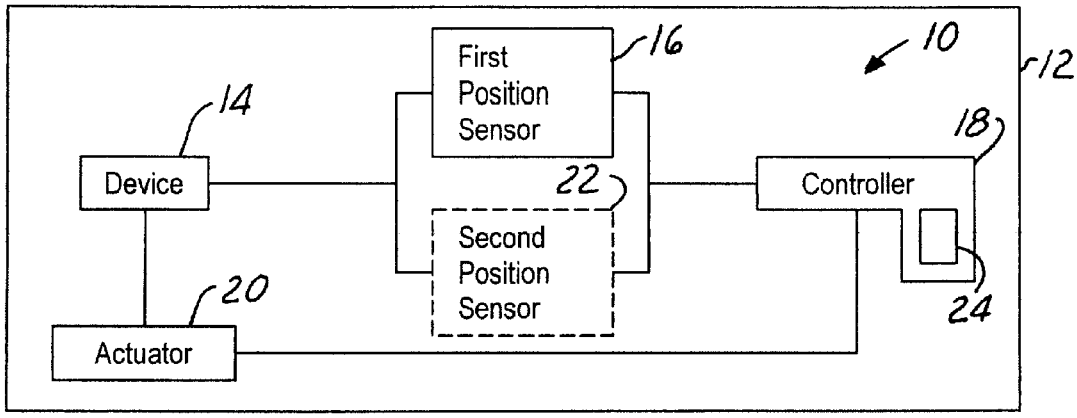
FIG. 1 is a block diagrammatic view of a control system in accordance with an embodiment of the present invention.

Referring now to FIG. 1, a block diagrammatic view of a control system 10 in accordance with an embodiment of the present invention is shown. The control system 10 is located within a vehicle 12. The control system 10 includes a device 14. A first position sensor 16 generates a first position sensor output signal corresponding to the position of the device 14. A controller 18 converts the position output signal into a first actual position signal. The controller 18 compares the first actual position signal to a desired signal and generates a position modification signal. The position modification signal is coupled to an actuator 20 to adjust the position of the device 14. A redundant position sensor 22 may be used to confirm the first position sensor output signal.

Controller 18 may be a microprocessor-based controller such as a computer having a central processing unit, memory (RAM and/or ROM), and associated inputs and outputs operating in cooperation with a communications bus. Controller 18 may be a portion of a main control unit, such as a powertrain control module or a main vehicle controller, or it may be a stand-alone controller.

The controller 18 utilizes a non-linear transfer function in converting the first position sensor output signal into the first actual position signal. The controller 18 may use one of the following non-linear transfer functions: a logarithmic-type, a square-type, or a divider-type as further described below, or other type having a continuous varying slope portion. Note the logarithmic-type, square-type, and divider-type transfer functions have continuously varying slopes, but other non-linear transfer functions having a continuous varying slope portion may be used. In other word, the transfer functions do not have break points. The non-linear transfer functions may be performed using solid state logic devices or computer software.

Figure 2:
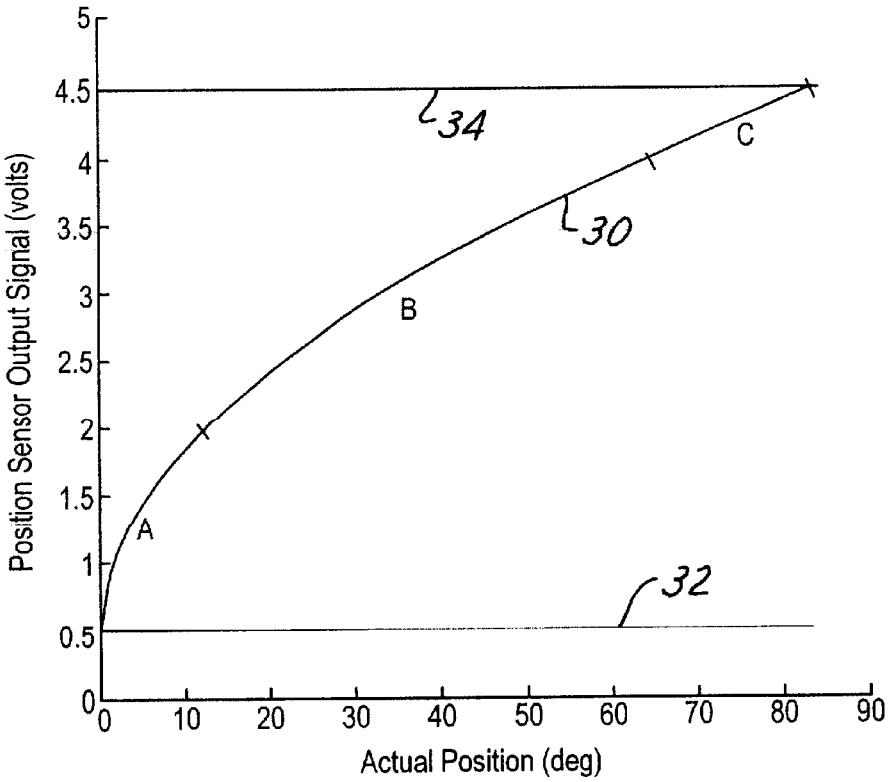
FIG. 2 is a plot illustrating an example of an output position signal defined by a logarithmic-type transfer function according to an embodiment of the present invention.

Referring now to FIG. 2, a plot illustrating an example of a logarithmic-type transfer function 30 according to an embodiment of the present invention is shown. Transfer function 30 corresponds to the following logarithmic-type transfer function equation:

$$deg=-15*[\log(1-(volts-0.5)/4]$$

where deg corresponds to the actual position of the device 14 in degrees and volts is the first position sensor output signal voltage. For the transfer functions mentioned in this application the controller 18 may set a predetermined low fault threshold and a high fault threshold, to limit the maximum and minimum values of a position sensor operating range. The low fault threshold is represented by line 32. The high fault threshold is represented by line 34. The logarithmic-type transfer function 30 is applicable in systems that have a controller with logarithmic conversion capabilities. For less sophisticated systems the following square-type transfer function and divider-type transfer function may be used. The non-linear transfer function 30, as with other non-linear transfer functions, may have a high-resolution range A, a medium-resolution range B, and a low-resolution range C. When the device 14 is a throttle, having three resolution ranges is preferred so as to have high resolution at lower position angles and lower resolution at higher position angles. The varying resolution in turn provides greater sensitivity at lower position angles.

Figure 3:
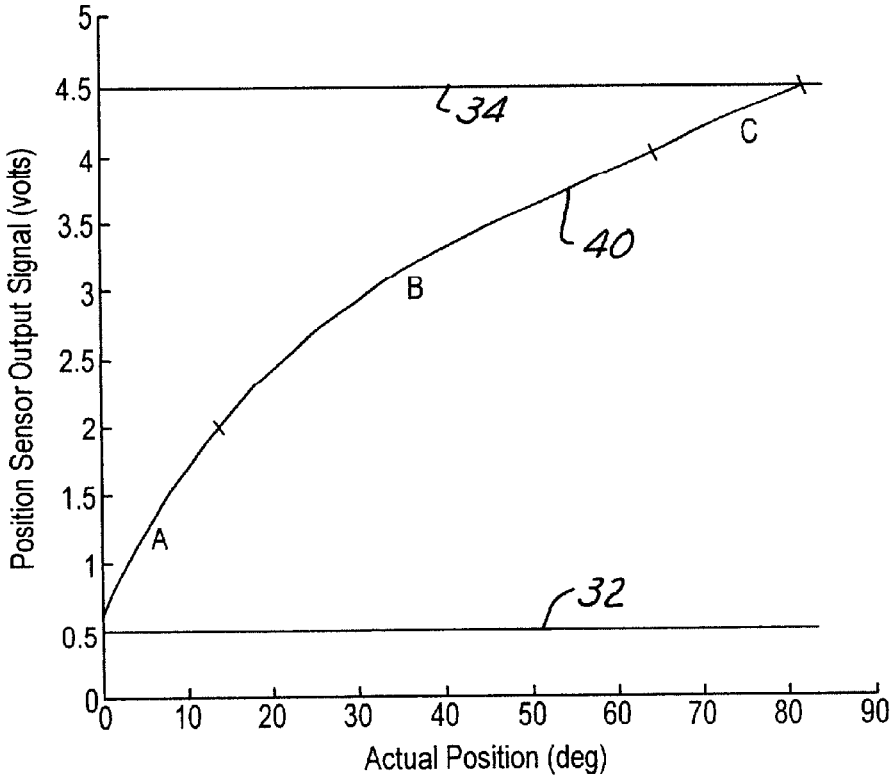
FIG. 3 is a plot illustrating an example of an output position signal defined by a square-type transfer function according to an embodiment of the present invention.

Referring now to FIG. 3, a plot illustrating an example of a square-type transfer function 40 according to an embodiment of the present invention is shown. Transfer function 40 corresponds to the following square-type transfer function equation:

$$deg=83*[(volts-0.5)/4]^2$$

where deg corresponds to the actual position of the device 14, volts is the first position sensor output signal voltage, and the number 83 is the maximum position of the device 14. The square-type transfer function 40 is the simplest to implement, as compared with the logarithmic-type and the square-type transfer functions, in that a non-sophisticated controller with only minimum mathematical calculation capability is able to use the square-type transfer function 40 with out the need for a look-up table.

Figure 4A:
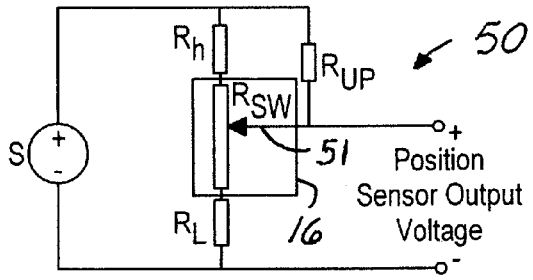
FIG. 4*a* is a divider-type electrical schematic for an output position signal defined by a divider-type transfer function according to an embodiment of the present invention.
Figure 4B:
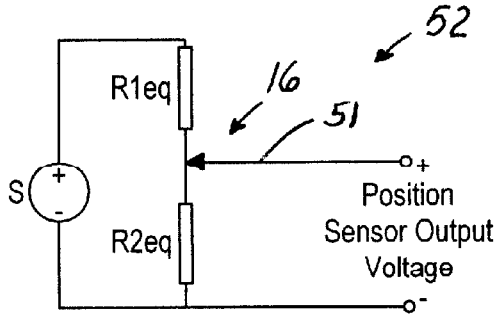
FIG. 4*b* is an equivalent electrical schematic of the schematic of FIG. 4*a* according to an embodiment of the present invention.
Figure 5:
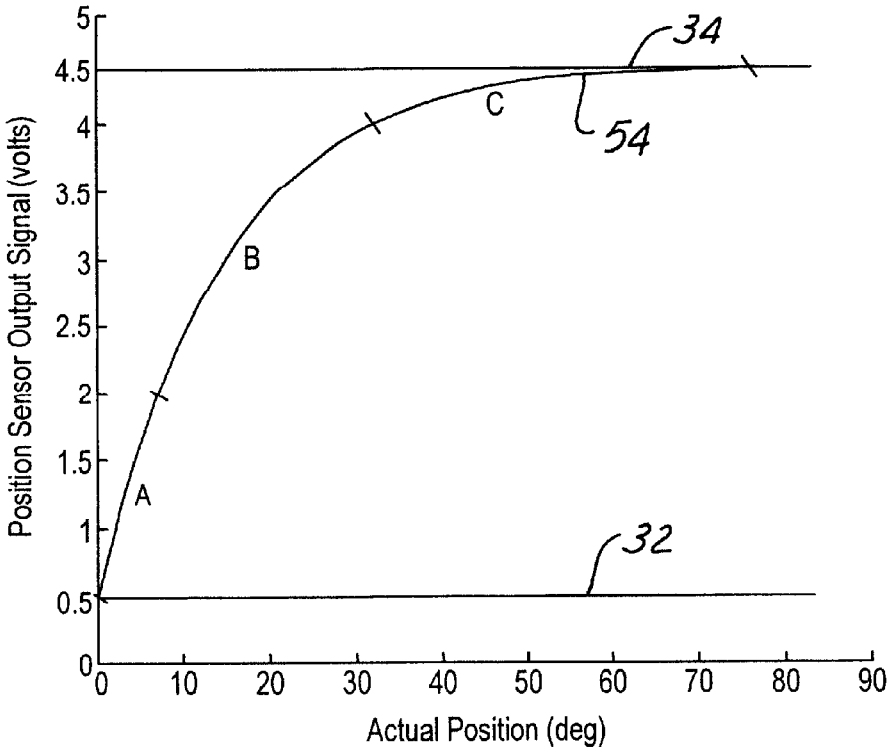
FIG. 5 is a plot illustrating an example of an output position signal defined by a divider-type transfer function according to an embodiment of the present invention.

Referring now to FIGS. 4A, 4B, and 5, of a divider-type electrical schematic 50, an equivalent electrical schematic 52, and a plot illustrating an example of a divider-type transfer function 54 according to an embodiment of the present invention. The wiper 51 corresponds to the variable or moving portion of the sensor. Wiper 51 travels between a maximum position and a minimum position and has a voltage output corresponding to the position.

where: Rh=position sensor resistor value above the maximum wiper position

Rsw=position sensor resistor value that wiper is able to travel

R1=position sensor resistor value below minimum wiper position

Rup=pull up resistor value

R1eq=[(Rh+Rsw−(deg/83)*Rsw)*Rup]/[Rh+Rsw−(deg/83)*Rsw+Rup]

R2eq=R1+Rsw*deg/83

Transfer function 54 corresponds to the following transfer function equation in conjunction with a look-up table 24:

$$volts=[5/(R1eq+R2eq)]*R2eq$$

Similarly, a pull down resistor may be used to get the desired low end resolution improvement with a negative sloping sensor. The judicious selections of pull up or pull down, or a combination thereof, can be used to provide the desired position resolution characteristics. The first position sensor output signal is converted into an equivalent first position sensor output signal, which is then converted into the first actual position signal through the use of the look-up table 24. The transfer function 54 also requires minimum mathematical calculation capability, but as stated requires the use of the look-up table 24, which is not required for the transfer functions 30 and 40.

Figure 6:
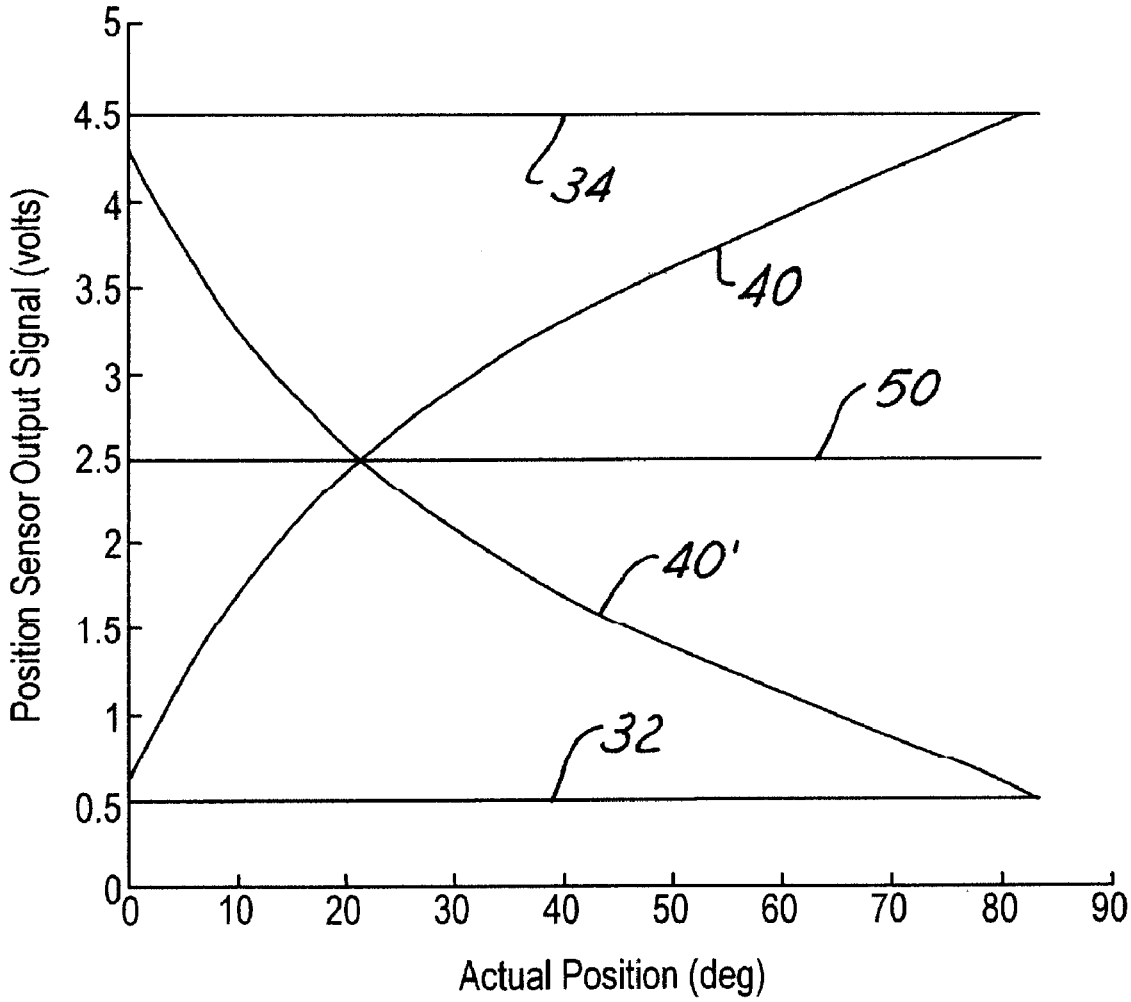
FIG. 6 is an example of two redundant position sensor transfer functions, used simultaneously, according to an embodiment of the present invention.

Referring now to FIGS. 1 and 6, an example of two redundant position sensor transfer functions, used simultaneously, according to an embodiment of the present invention is shown. The above-described transfer functions may be used with redundant position sensors. For example, when the transfer function 40 and the redundant position sensor 22 are used, a first transfer function 40 corresponding to the first position sensor 16, may be the inverse of a redundant transfer function 40' corresponding to a redundant position sensor. The transfer functions 40 and 40' are diverse such that they are mirror images of each other across a centerline 50. In so doing, the resulting signals from the first transfer function 40 and the redundant transfer function 40' may be added together at any point in time and result in the same constant value. When the constant value does not equal a set value the controller 18 may than determine that a fault exists on one or more of the position sensors 16 and 22. Also, when using a redundant position sensor in order to prevent common fault modes, whereby each position sensor is generating the same output signal, a traditional linear transfer function may be used in conjunction with a diverse related non-linear transfer function of the present invention. The combination of a linear transfer function and a non-linear transfer function reduces the potential for the two position sensors 40 and 40' to produce the same output value at any point in time, thereby, further preventing undetected faults.

Of the above-described transfer functions 30, 40, and 54, no transfer function is necessarily better than the other. The transfer function to use depends on the application and system capabilities. Also the values in the above non-linear transfer function equation are meant to be for example purposes. Other values may be used to adjust the shape of the transfer functions depending upon the application.

Figure 7:
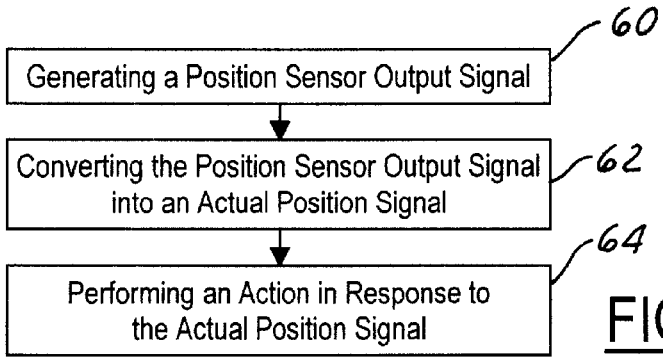
FIG. 7 is a logic flow diagram illustrating a method of performing an action within an automotive vehicle in accordance with an embodiment of the present invention.

Referring now to FIG. 7, a logic flow diagram illustrating a method of performing an action within the automotive vehicle 12 in accordance with an embodiment of the present invention is shown.

In step 60, the position sensor 16 generates a position sensor output signal corresponding to a position of the device 14.

In step 62, the controller 18 converts the position sensor output signal into an actual position signal utilizing a non-linear transfer function, as described above.

In step 64, controller 18 performs an action in response to the actual position signal. An action may include any of the following: adjusting the position of a device, recording a value, modifying the performance of a system, or other action that may be performed by a controller.

Figure 8:
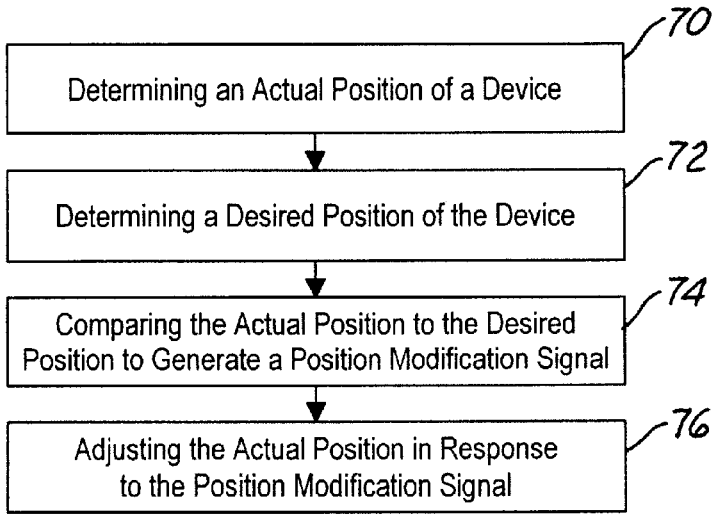
FIG. 8 is a logic flow diagram illustrating a method of controlling a position of a device within an automotive vehicle in accordance with an embodiment of the present invention.

Referring now to FIG. 8, a logic flow diagram illustrating a method of controlling a position of the device 14 within the automotive vehicle 12 in accordance with an embodiment of the present invention is shown.

In step 70, the controller 18 converts the position sensor output signal into an actual position signal utilizing a non-linear transfer function, as in step 62 above.

In step 72, the controller 18 determines a desired position of the device 14. The desired position of the device 14 may be a predetermined value stored in the controller memory or may be calculated using various formulas and parameters depending upon the resulting action to be performed.

In step 74, the controller 18 compares the actual position to the desired position and generates a position modification signal.

In step 76, the controller 18 transfers the position modification signal to the actuator 20 so as to adjust the actual position of the device 14.

The present invention by utilizing a nonlinear transfer function having a continuous varying slope portion, to determine a position of a device, provides increased resolution in a range where increased resolution is more desired over other ranges where a lower amount of resolution is sufficient. Also by providing several possible easy to manufacture and convert transfer function options allows the present invention to be versatile in that it may be applied in various related and unrelated applications.

The above-described method, to one skilled in the art, is capable of being adapted for various purposes and is not limited to the following applications: automotive vehicles, control systems, sensor systems, or other applications containing position sensors. The above-described invention may also be varied without deviating from the true scope of the invention.

What is claimed is:

1. A system for controlling an operational position of a throttle valve in an engine, said system comprising:

a position sensor operably connected to said throttle valve generating a first signal; and a controller operably connected to said position sensor, said controller configured to determine a current position of said throttle valve using a non-linear transfer function defining a curve with no breakpoints and said signal from said position sensor, said controller further configured to change said operational position of said throttle valve based on said current position and a desired position of said throttle valve.

2. The system of claim 1 wherein said throttle valve is operably disposed in an intake manifold of said engine.

3. A system as in claim 1 wherein said transfer function is a logarithmic-type transfer function.

4. A system as in claim 1 wherein said linear transfer function is a square root type transfer function.

5. A system as in claim 1 wherein said non-linear transfer function is a divider-type transfer function.

6. A method for determining an operational position of a throttle valve in an engine, said method comprising:

receiving a signal from a position sensor operably connected to said throttle valve; and, determining a current position of said throttle valve using a non-linear transfer function that defines a curve with no breakpoints and said signal from said position sensor.

7. The method of claim 6 wherein said transfer function comprises a monotonic continuous curve transfer function.

8. A method as in claim 6 wherein said transfer function is selected from the group consisting of: a logarithmic-type transfer function, a square root type transfer function, and a divider-type transfer function.

9. A method as in claim 6 wherein said transfer function comprises:

a high resolution range;

a medium resolution range; and a low resolution range.

10. A method as in claim 6 wherein said transfer function has a continuous varying slope distribution.

* * * * *